US005340158A

United States Patent [19]

Bartl

[11] Patent Number: 5,340,158

[45] Date of Patent: Aug. 23, 1994

[54] PACKING LIST AND SHIPPING LABEL COMBINATION

[75] Inventor: James C. Bartl, Chino Hills, Calif.

[73] Assignee: Best Label Co., Inc., Cerritos, Calif.

[21] Appl. No.: 135,457

[22] Filed: Oct. 12, 1993

Related U.S. Application Data

[63] Continuation of Ser. No. 939,034, Sep. 2, 1992, abandoned, which is a continuation of Ser. No. 827,869, Jan. 30, 1992, abandoned, which is a continuation of Ser. No. 607,900, Nov. 1, 1990, abandoned.

[51] Int. Cl.[5] ..... B42D 15/00

[52] U.S. Cl. ..... 283/81; 283/94; 283/101; 283/105; 283/901; 229/921

[58] Field of Search ..... 283/81, 79, 80, 94, 283/100, 101, 105, 107, 108, 109, 110, 111, 116, 117, 901; 40/159, 638; 229/71, 74, 92, 92.1, 92.3, 92.8, 921

[56] References Cited

U.S. PATENT DOCUMENTS

| | | | |
|---|---|---|---|
| 1,257,111 | 2/1918 | Phillips | 229/74 |
| 1,901,495 | 3/1933 | Davis | 229/74 |
| 3,155,234 | 11/1964 | Knoll et al. | 229/921 |
| 3,159,930 | 12/1964 | Allen et al. | 229/921 |
| 3,370,365 | 2/1968 | Vosbikian | 229/71 |
| 3,987,960 | 10/1976 | Gardiner | 283/81 |
| 4,640,030 | 2/1987 | Wood et al. | 283/116 |
| 4,742,954 | 5/1988 | Shishido | 283/94 |
| 4,868,027 | 9/1989 | Hunkeler et al. | 229/74 |
| 4,955,640 | 9/1990 | Anderson | 283/81 |
| 4,991,878 | 2/1991 | Cowan et al. | 283/81 |
| 4,995,642 | 2/1991 | Juszak et al. | 283/79 |

*Primary Examiner*—Mark Rosenbaum
*Assistant Examiner*—David P. Bryant
*Attorney, Agent, or Firm*—Price Gess & Ubell

[57] ABSTRACT

A shipping label that also functions as a packing list comprises a packet having a self-adhesive feature for attaching it to a shipping package with the same security of nonremovability as a standard shipping label. The packing list forms which are under the covering layer of the packet are multilayer composites that stick to the carton when applied but leave the sticky layer when pulled away. The packing list form has a place for the shipping address. The covering layer for the packet is opaque with a clear window overlaying the shipping address area. A packet may contain a plurality of packing list forms stuck one on top of the other. When each packing list form is pulled up it leaves a nonstick film on the one below it.

6 Claims, 2 Drawing Sheets

PACKING LIST AND SHIPPING LABEL COMBINATION

This application is a continuation of the application Ser. No. 07/939,034, filed on Sep. 2, 1992, now abandoned, which was a continuation of the application Ser. No. 07/827,869, filed on Jan. 30, 1992, now abandoned, which was a continuation of the application Ser. No. 07/607,900, filed on Nov. 1, 1990, now abandoned.

BACKGROUND OF THE INVENTION

1. Field of the Invention

The present invention relates generally to improvements in the labeling of packages which are shipped through the mail and, more particularly, pertains to new and improved packing lists and shipping labels.

2. Description of Related Art

In the field of labeling of packages to be shipped through the mails, it has been the practice to employ a separate and distinct shipping label to carry the shipping address and a separate and distinct packing list which is fastened to the exterior of the package by a see-through pouch which carries the packing list and is fastened by a self-adhesive layer to the package.

This type of labeling functions satisfactorily in the field. However, it requires, for the most part, human intervention for attaching the items to the package, as well as filling in the required information on the shipping label and the packing list.

There have been attempts to combine the function of an invoice with the function of an address label by creating a multilayered paper packet with carbonless paper, which would allow printing of the top sheet, which serves as an address label, and also print the invoice sheet underneath. These labeling packets are normally printed on a continuous web impact printer. They would be attached to a package by means of a self-adhesive backing.

These packets are made out of paper and are susceptible to being damaged by the normal rough handling that is typical of the mail transport system. As a result, an additional standard address label is required to be placed on a package containing these invoice packets. The concern is that if the invoice is inadvertently torn, the internal invoice sheet would be lost and the package would no longer contain an address.

The present invention alleviates all these concerns by providing a shipping label that also functions as a packing list which can be preprinted completely by computer-driven machinery and attached to the package by automated labelling equipment.

SUMMARY OF THE INVENTION

A shipping label that is also the packing list is provided by using a multilayer composite for the packing list, said composite having an adhesive bottom layer for attachment to the package. When pulled away from the package, the layers of the composite separate, leaving the adhesive bottom layer and a nonadhesive cover film on the package. A covering layer that is opaque, except for a window exposing the shipping address printed on the packing list, overlays the packing list and extends beyond the edges of the packing list to fasten to the package surface directly by a strip of adhesive around the periphery of said covering layer.

BRIEF DESCRIPTION OF THE DRAWINGS

The exact nature of this invention, as well as its objects and many of the attendant advantages, will be readily appreciated as the same becomes better understood by reference to the following detailed description when considered in conjunction with the accompanying drawings, in which like reference numerals designate like parts throughout the FIGURES thereof, and wherein.

DESCRIPTION OF THE PREFERRED EMBODIMENTS

Figure 1:
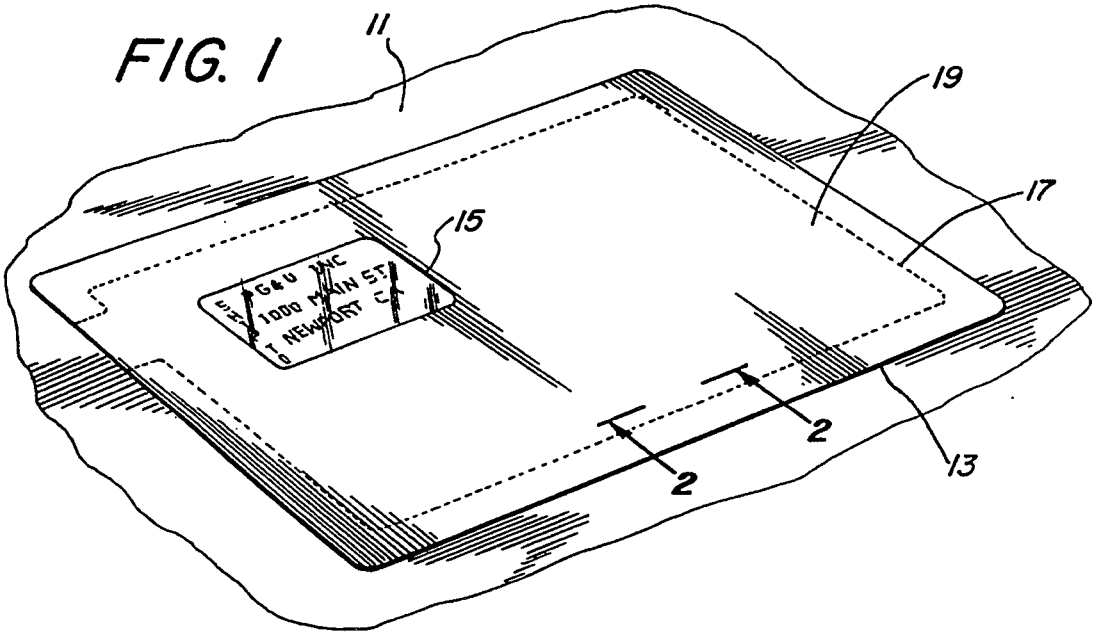
FIG. 1 is a perspective view of a shipping label according to the present invention placed on a package.

Referring first to FIG. 1, a preferred embodiment of the shipping label/packing list packet according to the present invention is illustrated, fastened to the surface 11 of a package. The shipping label/packing list packet 13 attaches to the package surface 11 peripherally by way of a contact adhesive on the underside of the shipping packet 13. The surface of shipping packet 13 is opaque except for a window 15 which overlays the shipping address located on the packing list documentation located below. The opaque surface layer also acts as a protecting layer. The surface layer of the shipping label/packing list packet 13 is perforated 17 around the edges to permit easy removal of the surface layer 19 of the shipping label packet 13 to thereby permit access to the packing list documentation contained underneath.

Figure 3:
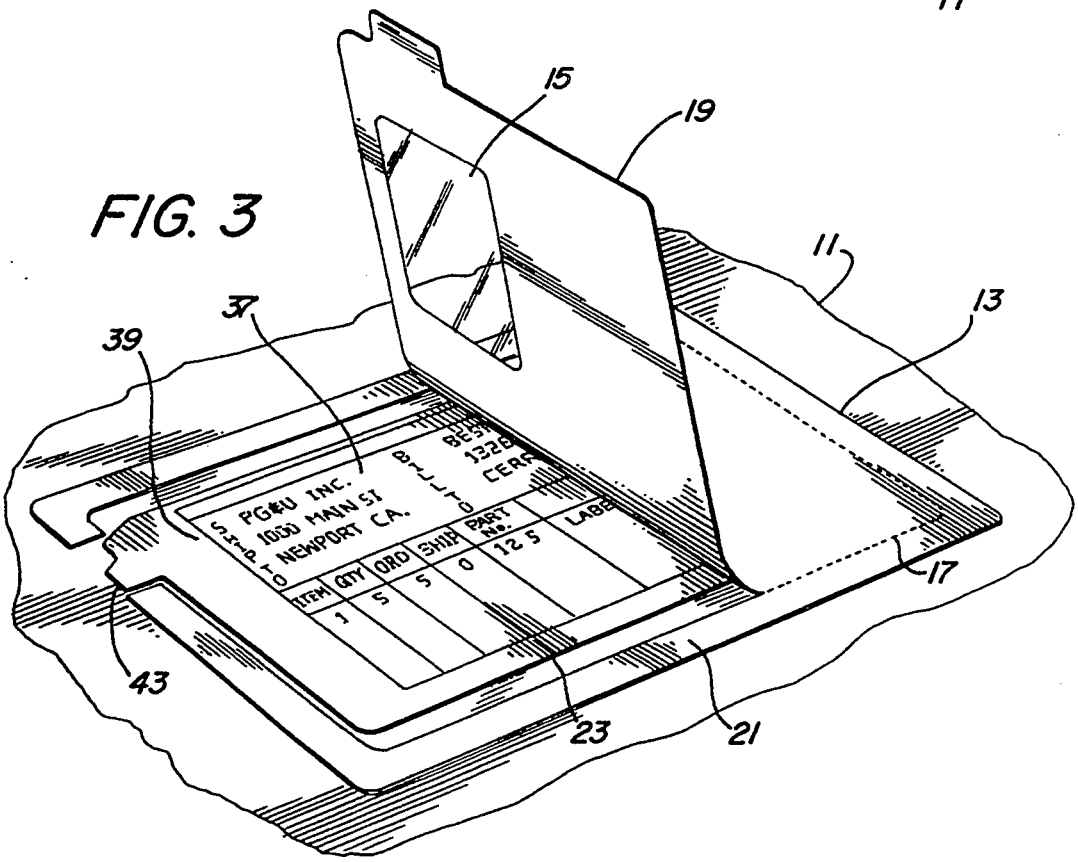
FIG. 3 is a perspective view of a shipping label according to the present invention with the covering label peeled back.

FIG. 3 illustrates more clearly the partial removal of surface layer 19 of shipping label packet 13. The surface layer 19 is simply pulled back and torn along the perforations 17 until completely removed.

The circumferential border 21 that stays attached to the surface 11 of the package as a result of the adhesive holding it to the surface 11 forms a pocket within which the packing list form 23 is located. The packing list 23 has a top surface 37 which is printed with information of a type that is appropriate for a packing list. In addition, a specific area 39 is reserved for the printing of the address to which the package is to be shipped. Packing list 23 is shown as having a tab 43 at its top left-hand side. This tab is designed to allow easy removal of the packing list 23 from the package, and also serves to align the covering layer 19 over packing list 23 so that the window 15 in the covering layer overlays the area 39 which contains the shipping address. An alternate preferred position for tab 43 is in the center equidistant from both ends.

Figure 2:
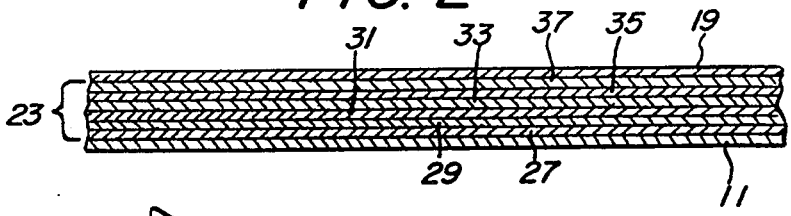
FIG. 2 is a cross-section of the shipping label of FIG. 1.

Referring now to FIG. 2, a cross-section of the shipping label packet is illustrated. Packing list 23 is sandwiched between the covering layer 19 and the package surface 11. The top layer 37 of packing list 23 is preferably a thermo-transfer printable film or a printable paper, or some other printable material of like characteristic. Layer 35, immediately beneath printable layer 37, is an adhesive which may be laid down in a pattern of any desired configuration or as a solid layer. Adhesive layer 35 holds the printable layer 37 to a clear film layer 33. Directly beneath the first clear film layer 33 is a layer of dry contact release coating. This dry contact release coating layer 31 holds a second layer of clear film 29 to the first layer 33 of clear film. Underneath the second layer of clear film 29 is a solid adhesive layer 27 which fixedly attaches the second layer of clear film to the surface of the package 11.

The combination of the first layer of clear film 33 and the second layer of clear film 29, held together by a layer of dry contact release coating 31 and the adhesive layer 27 underneath, is a composite material known in the trade as "MAGIC FILM", manufactured by Technicoat Corporation.

Once the composite 23 is attached to a base surface 11 by way of its bottom adhesive layer 27, the top layers 37, 35, and 33 can be removed simply by pulling up on tab 43. This direct pulling force will separate the first and second film layers 33 and 29, which are held together by the dry contact release coating layer 31. The second film layer 29 remains attached to the surface 11 of the package held fast by adhesive layer 27. The resulting bottom surface 33 of the packing list 23 is a nonadhesive film. This allows the packing list to be handled just like any other piece of paper for filing and other processing purposes.

Figure 4:
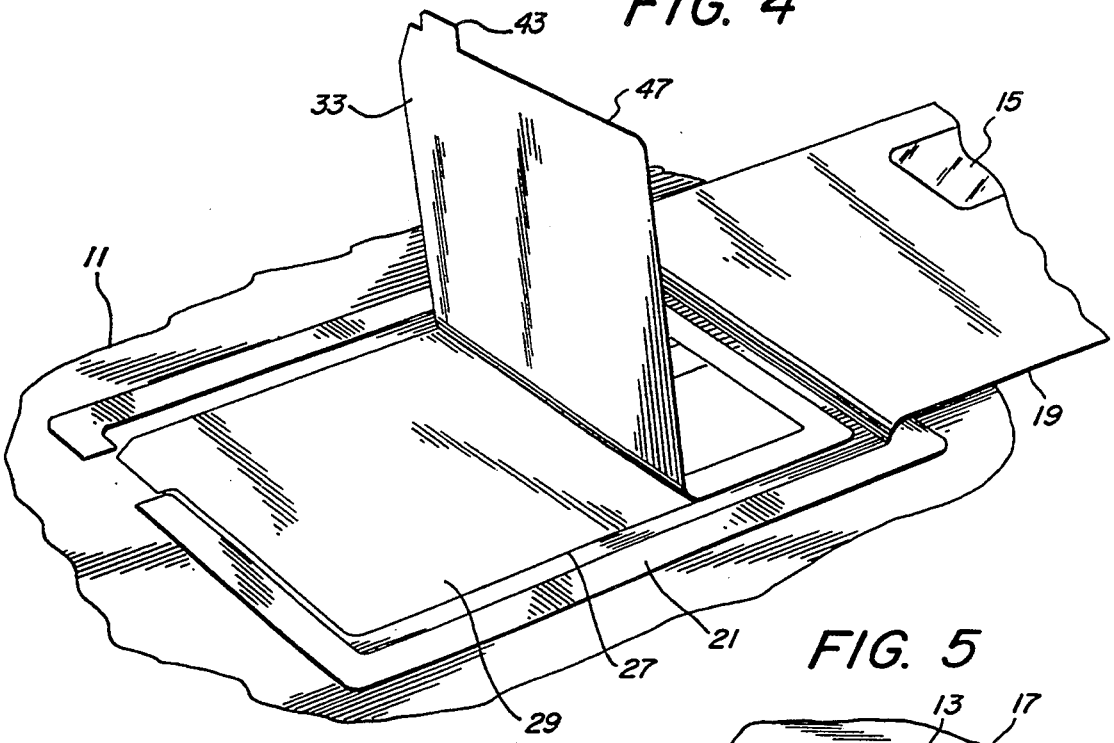
FIG. 4 is a perspective view of the shipping label according to the present invention with the covering layer peeled back and the packing list sheet partially removed from the package.

This removal and transformation function is more clearly illustrated in FIG. 4, which shows the cover layer 19 peeled all the way back and the top portion 47 of packing list 23 peeled back. The top portion 47 is the first three layers 37, 35, and 33 of the packing list composite 23. Layer 33, which is now the base of the packing list, is a clear, nonsticky film. Left behind, still attached to the surface 11 of the package, is the second layer of clear film 29 which is attached to the package 11 by way of the adhesive layer 27.

Figure 5:
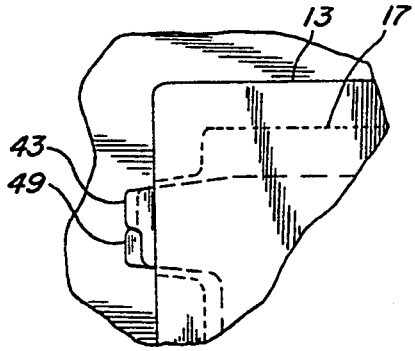
FIG. 5 is a planar view of one corner of the shipping label according to the present invention showing its tabs extending beyond the edge of the covering layer.
Figure 6:
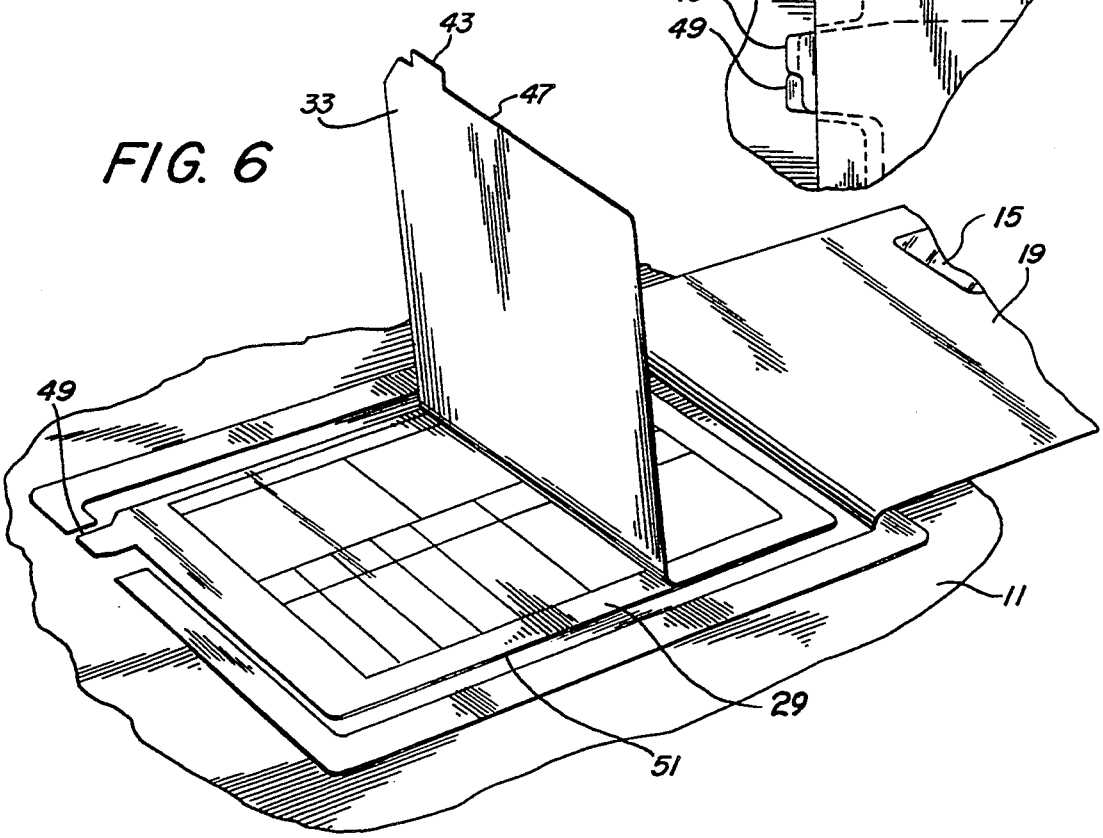
FIG. 6 is a perspective view of another embodiment of the shipping label according to the present invention showing the covering layer peeled back and the first of several shipping labels being removed from the package.

A plurality of packing list forms may be stacked on top of each other in the manner shown in FIGS. 5 and 6. When the package is large, containing many different items, it may become necessary to use more than one packing list form. In such an instance, the tabs 43, 49 (FIG. 5) are alternated spatially to allow for ease of separation between the individual packing lists contained within the shipping label packet 13. Once the covering layer 19 is pulled back, the top packing list is simply pulled up by its tab 43, taking away the top composite 47 which, as was stated above, consists of layers 37, 35, and 33. The bottom layer 29 of the top packing list remains attached to the second packing list 51. The bottom layer 29, as was noted above, consists of a clear film layer 29 and an adhesive layer 27 underneath. The bottom packing list 51 therefore has a clear film coating on its surface, as well as on its backside, when it is pulled up from the surface 11 of the package. This renders the packing list extremely durable in even humid environments.

In those instances where packing list durability during shipment and afterwards is of sufficient concern, the covering layer 19 of the shipping packet may also be a multilayer composite such as the packing list 23. Thus, for example, referring to FIG. 3, upon peeling back the covering layer 19 along its perforation lines 17, the top three layers of the composite layers 37, 35, and 33 would come up, leaving the bottom two layers 29 and 27 on the surface of packing list 23.

During shipment, the adhesive attachment between the covering layer 19 and the packing list 23 underneath adds additional security. After removal of the covering layer 19, the clear film left on the surface of shipping label 23, as well as the clear film layer that will be left on its underside, renders the packing list as secure as a laminated document.

What has been described is a shipping label that also functions as a packing list which is capable of withstanding the rigors of shipment through the mails and provides a packing list that is extremely durable. It should be understood that the present invention may be used to carry other than package container information, as desired, without departing from the spirit and scope of the invention. Each separate layer may contain different information regarding the package, as desired, such as return of merchandise instructions, or return label, for example.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A label structure attached to a package which is to be sent through the mail, said label structure functioning as both a shipping label and packing slip, said label structure comprising:

a first multilayer composite with an adhesive bottom layer permanently attached to a second multilayer composite, a top layer of printable material containing thereon printed indicia of at least the destination of the package and a description of its contents in separate sections thereof, and first and second clear film layers disposed between said bottom layer and said top layer and separated by a layer of dry contact release adhesive, said first multilayer composite separating between its first and second clear film layers when said top printed layer is pulled away from said adhesive bottom layer to leave the adhesive bottom layer and the second clear film layer permanently on said second multilayer composite and allowing removal of the top printed layer without any adhesive residue thereon, said first multilayer composite further including a tab portion without an adhesive backing projecting from a side of said first multilayer composite, whereby said top printed layer functions as a shipping label when attached to said package and functions as a packing slip when removed from said package;

a second multilayer composite with an adhesive bottom layer and a top layer of printable material containing printed indicia of the contents of the package, said second multilayer composite permanently attached by its adhesive bottom layer to said package, said first multilayer composite attached by its adhesive bottom layer to the top layer of said second multilayer composite, said second multilayer composite including first and second clear film layers disposed between the top layer and the bottom layer thereof and separated by a layer of dry contact release adhesive, said second multilayer composite separating between its first and second clear film layers when the top layer of said second multilayer composite is pulled away from said adhesive bottom layer of said second multilayer composite to leave the adhesive bottom layer and the second clear film of said second multilayer composite permanently on the package, whereby said top layer of said second multilayer composite functions as a packing slip when removed from the package; and an opaque covering layer overlaying and extending beyond the edges of said first and second multilayer composites, said covering layer having an adhesive backing permanently attached to said package around the periphery of said first and second multilayer composites, and further including a window therein which is aligned with the destination address on the top layer of said first multilayer composite to allow a clear view of the destination address through said window; and

2. The label structure of claim 1 wherein said covering layer is perforated along a circumference that outlines said multilayer composites to permit detachment of the portion of said covering layer within said circumference.

3. The label structure of claim 2 wherein said first multilayer composite and said second multilayer composite each have a tab portion projecting from a side thereof which does not have an adhesive backing.

4. The label structure of claim 3 wherein the perforations in said covering layer outline said tab portions and extend to an edge of the covering layer adjacent said tab portions.

5. A label structure attached to a package which is to be sent through the mail, said label structure functioning both as a shipping label and packing slip, said label structure comprising:

a multilayer composite with an adhesive bottom layer permanently attached to said package, a top layer of printable material containing thereon printed indicia of at least the destination of the package and a description of its contents in separate sections thereof, and first and second clear film layers disposed between said top layer and said bottom layer and separated by a layer of dry contact release adhesive, said multilayer composite separating between its first and second clear film layers when said top printed layer is pulled away from said package to leave the adhesive bottom layer and the second clear film layer permanently on the package and allowing removal of the top printed layer without any adhesive residue thereon, said multilayer composite further including a tab portion without an adhesive backing projecting from a side of said multilayer composite, whereby said top printed layer functions as a shipping label when attached to said package and functions as a packing slip when removed from said package; and an opaque covering layer overlaying and extending beyond the edges of said multilayer composite, said covering layer having an adhesive backing permanently attached to said package around the periphery of said multilayer composite, and further including a window therein which is aligned with the destination address on the top layer of said multilayer composite to allow a clear view of the destination address through said window, said covering layer being perforated along a circumference that outlines said periphery of said multilayer composite to permit detachment of the portion of said covering layer within said circumference and subsequent removal of said top printed layer, said perforated circumference being positioned on said opaque covering layer such that said tab portion of said multilayer composite is accessible when said covering layer portion defined by said perforated circumference is detached, said perforated circumference including a tab portion which is in overlapping alignment with said tab portion of said multilayer composite.

6. A label structure attached to a package which is to be sent through the mail, said label structure functioning both as a shipping label and packing slip, said label structure comprising:

a plurality of multilayer composites, each multilayer composite having an adhesive bottom layer, a top layer of printable material containing thereon printed indicia of at least the destination address of the package and a description of its contents in separate sections thereof, and first and second clear film layers disposed between said top layer and said bottom layer and separated by a layer of dry contact release adhesive, each multilayer composite separating between its first and second clear film layers when its top printed layer is pulled away from its adhesive bottom layer allowing removal of its top printed layer without any adhesive residue thereon, said plurality of multilayer composites being sequentially stack one on top of another to form a stack of multilayer composites, a bottom multilayer composite being permanently secured to the package with its adhesive bottom layer, the stack having been formed by successively stacking the remainder of said multilayer composites one on top of another on top of said bottom multilayer composite, with the adhesive bottom layer of each multilayer composite being attached to the top layer of a multilayer composite therebelow, said plurality of multilayer composites each further including a tab portion without adhesive backing projecting from a side of each of said multilayer composites, said tab portions being spatially positioned relative to each other to facilitate separation of a respective multilayer composite from said stack; and an opaque covering layer overlaying and extending beyond the edges of said stack of multilayer composites, said covering layer having an adhesive backing permanently attached to said package around the periphery of said stack of multilayer composites, and further including a window therein which is aligned with the destination address on the top layer of the topmost multilayer composite of said stack to allow a clear view of said destination address on said topmost multilayer composite through said window, said covering layer being perforated along a circumference that outlines said periphery of said stack of multilayer composites to permit detachment of the portion of said covering layer within said circumference and thereby provide access to said stack, said perforated circumference being positioned on said opaque covering layer such that said tab portions are accessible when said covering layer portion defined by said perforated circumference is detached, said perforated circumference including a tab portion which is in overlapping alignment with said tab portions of said plurality of multilayer composites.

* * * * *